US011651742B2

(12) United States Patent
Lee et al.

(10) Patent No.: US 11,651,742 B2
(45) Date of Patent: May 16, 2023

(54) ORGANIC LIGHT EMITTING DISPLAY DEVICE AND DRIVING METHOD THEREOF

(71) Applicant: LG DISPLAY CO., LTD., Seoul (KR)

(72) Inventors: Cheol Su Lee, Seoul (KR); Dong Hoon Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/829,804

(22) Filed: Jun. 1, 2022

(65) Prior Publication Data

US 2022/0415264 A1 Dec. 29, 2022

(30) Foreign Application Priority Data

Jun. 24, 2021 (KR) ..... 10-2021-0082530

(51) Int. Cl.
*G09G 3/3291* (2016.01)
*G09G 3/00* (2006.01)

(52) U.S. Cl.
CPC ..... *G09G 3/3291* (2013.01); *G09G 3/006* (2013.01); *G09G 2300/0876* (2013.01); *G09G 2320/045* (2013.01); *G09G 2330/12* (2013.01)

(58) Field of Classification Search
CPC ..... G09G 2320/043; G09G 2320/0233; G09G 2320/0295; G09G 2320/0257; G09G 2320/0693; G09G 3/30; G09G 3/3291; G09G 3/3233; G09G 2300/0819; G09G 2300/043; G09G 2300/0852
See application file for complete search history.

(56) References Cited

U.S. PATENT DOCUMENTS

2016/0189625 A1 6/2016 Kim et al.
2018/0053462 A1* 2/2018 Bae ..... G09G 3/2074
2020/0193918 A1 6/2020 Hwang et al.
2021/0056890 A1* 2/2021 Kim ..... G09G 3/32

FOREIGN PATENT DOCUMENTS

KR 10-2015-0027906 3/2015
KR 10-2016-0078867 7/2016

OTHER PUBLICATIONS

European Search Report dated Oct. 17, 2022 issued in Patent Application No. 22177412.8 (10 pages).

* cited by examiner

*Primary Examiner* — Dong Hui Liang
(74) *Attorney, Agent, or Firm* — Polsinelli PC

(57) ABSTRACT

An organic light emitting display device includes an organic light emitting element emitting light, a driving transistor configured to control a driving current supplied to the organic light emitting element, a first switch transistor configured to transfer a voltage input through a data line to a first node of the driving transistor, a second switch transistor turned on/off simultaneously with the first switch transistor to connect a second node of the driving transistor and a sensing line, a sensing capacitor connected to the sensing line to store a sensing voltage during an organic light emitting element threshold voltage sensing period, and a first switch configured to disconnect the sensing capacitor from the sensing line during a period in which sensing data for sensing a threshold voltage of the organic light emitting element is input to the data line and to connect the sensing capacitor to the sensing line during the organic light emitting element threshold voltage sensing period.

12 Claims, 11 Drawing Sheets

ORGANIC LIGHT EMITTING DISPLAY DEVICE AND DRIVING METHOD THEREOF

CROSS-REFERENCE TO RELATED APPLICATION

This application claims the priority of Korean Patent Application No. 10-2021-0082530, filed on Jun. 24, 2021, which is hereby incorporated by reference in its entirety.

BACKGROUND

Field of the Disclosure

The present disclosure relates to an organic light emitting display device and a driving method thereof.

Description of the Background

An organic light emitting display device includes sub-pixels each including an organic light emitting diode (OLED) and arranged in a matrix form and displays an image by adjusting the luminance of the sub-pixels according to gray levels of image data. The sub-pixels include light emitting elements and driving thin film transistors (TFT) for controlling a driving current input to the light emitting elements.

The sub-pixels of the organic light emitting display device tend to be deteriorated with changes in a threshold voltage as driving time elapses. When the threshold voltage changes, image quality is deteriorated due to deviation in current flowing through the organic light emitting diodes (OLED) even when the same data voltage Vdata is applied. In order to solve this problem, various compensation methods for compensating for deterioration of the organic light emitting display device have been studied.

A method of sensing deterioration may vary according to a sub-pixel structure. Accordingly, there is a need for a method for effectively sensing and compensating for deterioration characteristics depending on a sub-pixel structure.

SUMMARY

Accordingly, the present disclosure is directed to an organic light emitting display device and a driving method thereof that substantially obviate one or more of problems due to limitations and disadvantages described above.

More specifically, the present disclosure is to provide an organic light emitting display device and a driving method thereof capable of sensing and compensating for deterioration of an organic light emitting diode (OLED) in an organic light emitting display device including a sub-pixel having a 1-scan structure.

To achieve these and other advantages and in accordance with the purpose of the disclosure, as embodied and broadly described herein, an organic light emitting display device includes an organic light emitting element emitting light, a driving transistor configured to control a driving current supplied to the organic light emitting element, a first switch transistor configured to transfer a voltage input through a data line to a first node of the driving transistor, a second switch transistor turned on/off simultaneously with the first switch transistor to connect a second node of the driving transistor and a sensing line, a sensing capacitor connected to the sensing line to store a sensing voltage during an organic light emitting element threshold voltage sensing period, and a first switch configured to disconnect the sensing capacitor from the sensing line during a period in which sensing data for sensing a threshold voltage of the organic light emitting element is input to the data line and to connect the sensing capacitor to the sensing line during the organic light emitting element threshold voltage sensing period.

The organic light emitting display device may further include a capacitor electrically connected between the first node and the second node.

The first switch transistor and the second switch transistor cancan maintain a turned-on state during the period in which the sensing data is input and the threshold voltage sensing period.

The organic light emitting display device cancan further include a sensing unit connected to the sensing line to sample a voltage of the sensing capacitor and output a sensing result related to the threshold voltage of the organic light emitting element.

The sensing unit cancan include a second switch configured to connect the sensing line and a first reference voltage for initializing the second node, a third switch configured to connect the sensing line and a second reference voltage for grounding the second node, and a fourth switch configured to connect the sensing line and an analog-to-digital converter to sample the voltage of the sensing capacitor.

The organic light emitting display device cancan further include a timing controller configured to receive the sensing result from the sensing unit and to calculate the threshold voltage of the organic light emitting element by calculating a voltage change rate per unit time in the sensing capacitor according to the sensing result.

A sensing mode for sensing the threshold voltage of the organic light emitting element cancan include first to sixth periods, wherein the first switch transistor and the second switch transistor cancan be turned on in the first to sixth periods, a sensing data voltage for driving the sensing mode cancan be input to the first node of the driving transistor through the data line, and the first reference voltage cancan be input to the second node of the driving transistor through the sensing line in the first period, input of the first reference voltage cancan be canceled and input of the sensing data voltage cancan be maintained to increase a potential of the second node to a threshold voltage at which the organic light emitting element is turned on in the second period, the data voltage of the first node cancan be maintained in a floating state, and the second reference voltage lower than the first reference voltage cancan be input to the sensing line to adjust the potential of the second node increased to the threshold voltage to the second reference voltage in the third period, the sensing capacitor cancan be connected to the sensing line to sense a voltage difference between the second node adjusted to the second reference voltage and the first node in which voltage adjustment of the second node has been reflected using the sensing capacitor in the fourth period, and the voltage sensed by the sensing capacitor cancan be sampled in the fifth period.

After the fifth period, a black data voltage cancan be input to the first node of the driving transistor through the data line and the first reference voltage cancan be input to the second node of the driving transistor through the sensing line in the sixth period.

In another aspect of the present disclosure, a method of driving an organic light emitting display device in which a plurality of data lines and a plurality of sensing lines are disposed, and a plurality of sub-pixels each having an organic light emitting element and a driving transistor are arranged includes a first period in which a sensing data voltage for driving a sensing mode is input to a first node of the driving transistor through a corresponding data line, and a first reference voltage is input to a second node of the driving transistor through a corresponding sensing line at the time of driving the sensing mode for sensing a threshold voltage of the organic light emitting element, a second period in which input of the first reference voltage to the second node is canceled and input of the sensing data voltage is maintained to increase a potential of the second node to a threshold voltage at which the organic light emitting element is turned on, a third period in which the data voltage of the first node is maintained in a floating state, and a second reference voltage lower than the first reference voltage is applied to the sensing line to adjust the potential of the second node increased to the threshold voltage to the second reference, a fourth period in which a sensing capacitor is connected to the sensing line to sense a voltage difference between the second node adjusted to the second reference voltage and the first node in which voltage adjustment of the second node has been reflected using the sensing capacitor, and a fifth period in which the voltage sensed by the sensing capacitor is sampled.

After the fifth period, a black data voltage cancan be input to the first node of the driving transistor through the data line and the first reference voltage cancan be input to the second node of the driving transistor through the sensing line in the sixth period.

The method cancan further include calculating a voltage change rate per unit time in the sensing capacitor based on the voltage sensed by the sensing capacitor and calculating the threshold voltage of the organic light emitting element according to the voltage change rate to compensate for an image data voltage input to the organic light emitting element.

Each sub-pixel cancan include a first transistor electrically connected to the first node of the driving transistor and a corresponding data line among the plurality of data lines, a second transistor electrically connected to the second node of the driving transistor and a corresponding sensing line among the plurality of sensing lines according to the same scan signal input through the same scan line as that for the first transistor, and a capacitor electrically connected between the first node and the second node of the driving transistor.

The organic light emitting display device cancan further include a sensing unit configured to sample a voltage input through the sensing line and output a sensing voltage related to the threshold voltage of the organic light emitting element.

The sensing unit cancan include a first switch configured to connect the sensing line and the sensing capacitor, a second switch configured to connect the sensing line and a first reference voltage for initializing the second node, a third switch configured to connect the sensing line and a second reference voltage for grounding the second node, and a fourth switch configured to connect the sensing line and an analog-to-digital converter to sample the voltage of the sensing capacitor.

The organic light emitting display and the driving method thereof according to the present disclosure can sense OLED degradation characteristics for a sub-pixel having a 1-scan structure as in a conventional sub-pixel having a 2-scan structure.

In addition, the organic light emitting display device and the driving method thereof according to the present disclosure can reduce a time required to sense OLED degradation characteristics.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
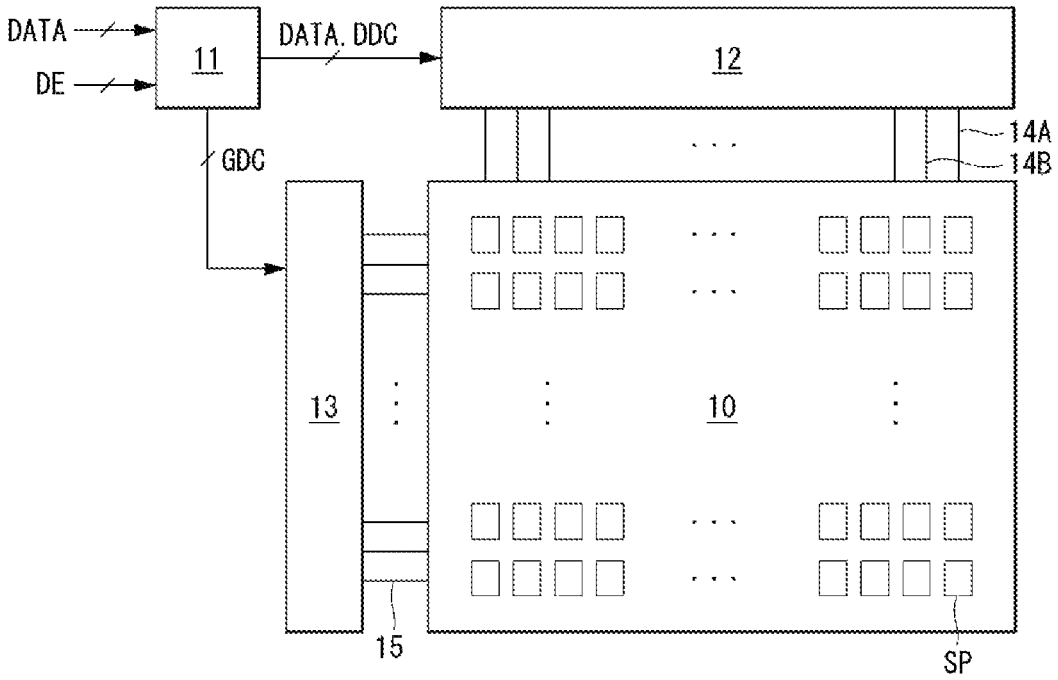
FIG. 1 is a schematic block diagram of a display device having a current sensing function according to an aspect of the present disclosure.

The advantages and features of the present disclosure and the way of attaining the same will become apparent with reference to aspects described below in detail in conjunction with the accompanying drawings. The present disclosure, however, is not limited to the aspects disclosed hereinafter and can be embodied in many different forms. Rather, these exemplary aspects are provided so that this disclosure will be thorough and complete and will fully convey the scope to those skilled in the art. Thus, the scope of the present disclosure should be defined by the claims.

In the drawings for explaining the exemplary aspects of the present disclosure, for example, the illustrated shape, size, ratio, angle, and number are given by way of example, and thus, are not limited to the disclosure of the present disclosure. Throughout the present specification, the same reference numerals designate the same constituent elements. In addition, in the following description of the present disclosure, a detailed description of known functions and configurations incorporated herein will be omitted when it can make the subject matter of the present disclosure rather unclear. The terms "comprises", "includes" and/or "has", used in this specification, do not preclude the presence or addition of other elements unless it is used along with the term "only". The singular forms are intended to include the plural forms as well, unless the context clearly indicates otherwise.

In interpreting a component, it is interpreted as including an error range even if there is no separate explicit description.

When describing positional relationships, for example, when the positional relationship between two parts is described using "on", "above", "below", "aside", or the like, one or more other parts can be located between the two parts unless the term "directly" or "closely" is used.

In the following description of the aspects, "first" and "second" are used to describe various components, but such components are not limited by these terms. The terms are used to discriminate one component from another component. Accordingly, a first component mentioned in the following description can be a second component within the technical spirit of the present disclosure.

The same or extremely similar elements are designated by the same reference numerals throughout the specification.

Hereinafter, aspects of the present disclosure will be described in detail with reference to the attached drawings. In the description of the present disclosure, a detailed description of related known technologies will be omitted when it can make the subject matter of the present disclosure rather unclear.

FIG. 1 is a schematic block diagram of a display device according to an aspect of the present disclosure.

Referring to FIG. 1, the display device includes a display panel 10 in which a plurality of pixels is formed, a scan driver 13, a data driver 12, and a timing controller 11.

A plurality of data lines 14A, a plurality of sensing lines 14B, and a plurality of scan lines 15 are disposed in the display panel 10. Sub-pixels SP are disposed at the intersections of the plurality of data lines 14A, the plurality of sensing lines 14B, and the plurality of scan lines 15. Each sub-pixel SP includes a light emitting element (hereinafter referred to as an OLED) and switch elements such as a driving TFT and a switch TFT for driving the OLED.

The timing controller 11 supplies the image data DATA to the data driver 12. The timing controller 11 converts external input image data into a data signal format used in the data driver 12 and outputs converted image data DATA.

In addition, the timing controller 11 supplies various control signals DDC and GDC necessary for operations of the data driver 12 and the scan driver 13 to control the operations of the data driver 12 and the scan driver 13.

The scan driver 13 outputs a scan signal in response to the gate timing control signal GDC supplied from the timing controller 11. The scan driver 13 can output a scan signal including a scan high voltage and a scan low voltage through the scan lines 15.

The data driver 12 converts the data signal DATA into an analog data voltage according to the data timing control signal DDC during a display mode operation and supplies the analog data voltage to the display panel 10. During a sensing mode operation, the data driver 12 can sense deterioration of the OLED included in at least one of the sub-pixels SP.

The timing controller 11 operates in a display mode for displaying an image and a sensing mode for sensing OLED deterioration.

In the display mode, the timing controller 11 receives driving signals including a data enable signal DE or a vertical synchronization signal, a horizontal synchronization signal and a clock signal, and a data signal DATA for image display from an image processor (not shown). The timing controller 11 generates the gate timing control signal GDC for controlling the operation timing of the scan driver 13 and the data timing control signal DDC for controlling the operation timing of the data driver 12 based on the received driving signals. The timing controller 11 transmits the data timing control signal DDC and the data signal DATA to the data driver 12 and transmits the gate timing control signal GDC to the scan driver 13.

In the sensing mode, the timing controller 11 can transmit a control signal for sensing operation to the scan driver 13 and the data driver 12 to receive feedback of deterioration data of the OLED of a sub-pixel SP. The timing controller 11 can correct the data signal DATA to be written in the sub-pixel SP based on the OLED deterioration data fed back from the data driver 12.

Figure 2:
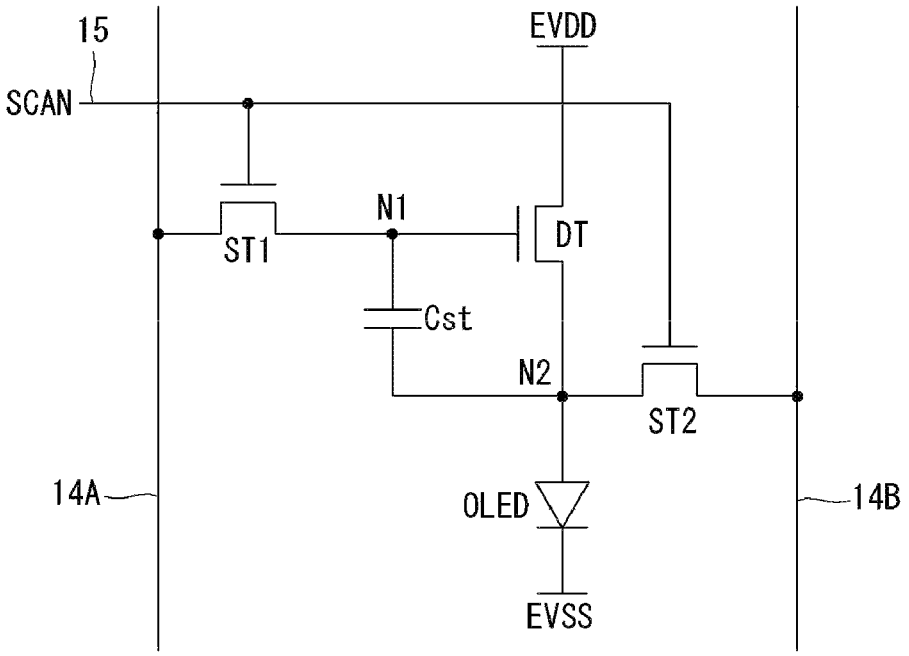
FIG. 2 is an exemplary diagram of a sub-pixel circuit formed in a display panel of FIG. 1.

FIG. 2 is an exemplary diagram of a sub-pixel circuit formed in the display panel of FIG. 1.

Referring to FIG. 2, the sub-pixel receives a high-potential driving voltage EVDD and a low-potential driving voltage EVSS from a power generator (not shown). The sub-pixel may include an OLED, a driving TFT DT, a storage capacitor Cst, a first switch TFT ST1 and a second switch TFT ST2.

The OLED has an anode and a cathode. In the OLED, the anode is connected to the low-potential driving voltage EVSS and the cathode is connected to the source node or the drain node of the driving TFT DT. Accordingly, the emission luminance of the OLED can be adjusted according to the magnitude of driving current input to the cathode.

The driving TFT DT supplies the driving current to the OLED according to the potential difference between the gate electrode and the source electrode. The driving TFT DT includes a gate electrode, a first electrode, and a second electrode. Here, the first electrode can be a drain electrode and the second electrode can be a source electrode. The first electrode is connected to the high-potential driving voltage EVDD and the second electrode is connected to the gate node N1 of the driving TFT DT connected to the anode of the OLED. The gate electrode is connected to the source node N2 of the driving TFT DT connected to the first switch TFT ST1.

The first switch TFT ST1 transfers a data voltage Vdata to the gate node N1 of the driving TFT DT. The first switch TFT ST1 is controlled to be turned on/off according to a scan signal SCAN applied to the gate electrode to electrically connect or disconnect the gate node N1 of the driving TFT DT to or from a data line 14A.

The gate electrode of the second switch TFT ST2 is connected to a scan line 15B, a first electrode thereof is connected to the source node N2, and a second electrode thereof is connected to a sensing line 14B. The second switch TFT ST2 connects the source node N2 and the sensing line 14B according to the scan signal SCAN input to the gate electrode. The second switch TFT ST2 can be turned on by the scan signal SCAN to supply a reference voltage Vref supplied to the sensing line 14B to the source node N2 and transfer the voltage of the source node N2 to the data driver 12 through the sensing line 14B.

The storage capacitor Cst is connected between the gate node N1 and the source node N2 of the driving TFT DT. The storage capacitor Cst maintains a gate-source voltage Vgs of the driving TFT DT at a constant potential for one frame time.

In the present aspect, a case of a 1-scan structure in which one sub-pixel SP is driven by receiving one scan signal SCAN is exemplified. Accordingly, the first switch TFT ST1 and the second switch TFT ST2 included in the sub-pixel SP can be simultaneously controlled to be turned on/off by receiving the same scan signal SCAN.

Figure 3:
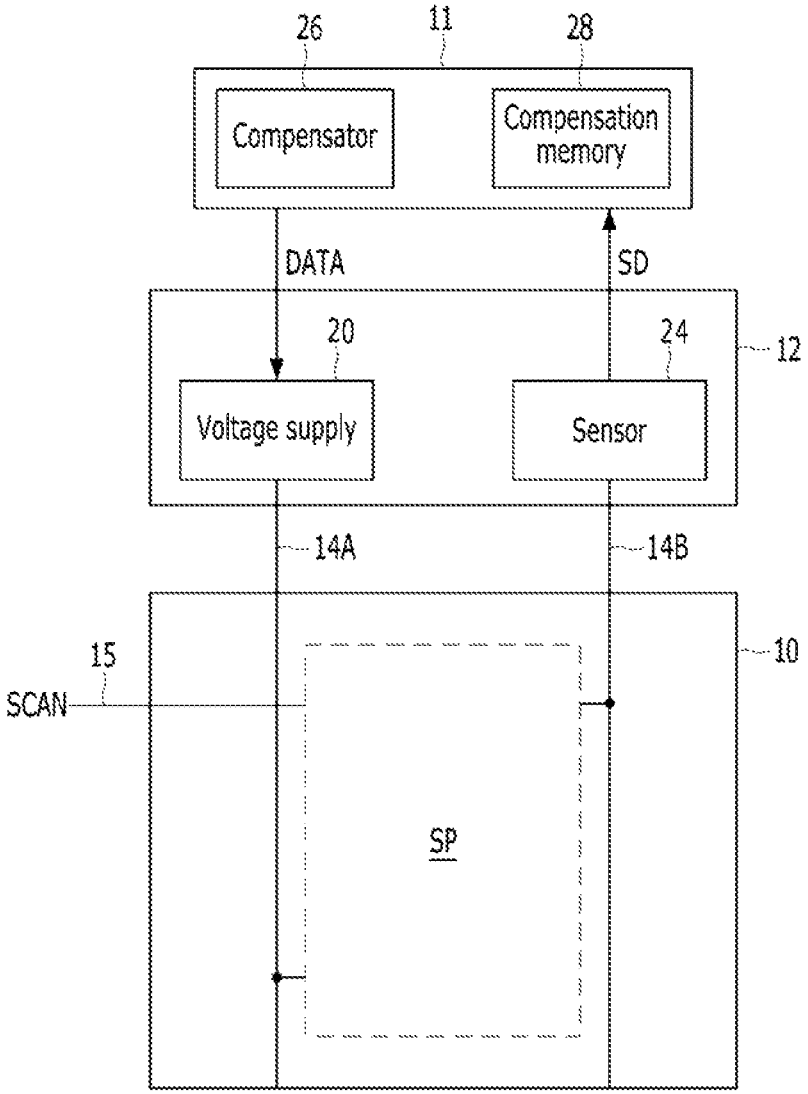
FIG. 3 is a diagram schematically showing a configuration of a compensation circuit using a timing controller and a data driver according to an aspect of the present disclosure.

FIG. 3 is a diagram schematically showing a configuration of a compensation circuit using the timing controller 11 and the data driver 12 according to an aspect of the present disclosure. The circuit for sensing OLED deterioration may be included in the data driver 12 or implemented as a separate sensing circuit outside the data driver 12. Hereinafter, an example in which the sensing circuit is included in the data driver 12 will be described.

Referring to FIG. 3, the timing controller 11 may include a compensation memory 28 in which sensing data SD for data compensation is stored and a compensator 26 that compensates for a data signal DATA to be written in the sub-pixel SP based on the sensing data SD.

In the sensing mode, the timing controller 11 controls general operations for sensing OLED deterioration according to a predetermined sensing processing.

The data driver 12 includes a voltage supply unit 20 that outputs a data voltage to be written in the sub-pixel SP and a sensing unit 24 that senses OLED deterioration.

The voltage supply unit 20 may output a display data voltage or a sensing data voltage through a data channel connected to the data line 14A. The voltage supply unit 20 may have a plurality of data channels. The voltage supply unit 20 may include a digital-to-analog converter (DAC) that converts a digital signal into an analog signal, and generate the display data voltage or the sensing data voltage.

The voltage supply unit 20 generates the display data voltage in response to the data timing control signal DDC provided by the timing controller 11 in the display mode. The voltage supply unit 20 supplies the display data voltage to the data line 14A. In the display mode, the display data voltage supplied to the data line 14A is applied to the sub-pixel SP in synchronization with a turn-on timing of a display scan signal SCAN.

In the sensing mode, the voltage supply unit 20 generates a preset sensing data voltage and supplies the same to the data line 14A. In the sensing mode, the sensing data voltage supplied to the data line 14A is applied to the sub-pixel SP in synchronization with a turn-on timing of the scan signal SCAN.

The sensing unit 24 senses OLED deterioration through the sensing line 14B. The sensing unit 24 can sense the voltage of the source node N2 of the sub-pixel SP. The sensing unit 24 can drive the sensing mode under the control of the timing controller 11. The sensing unit 24 can sense and sample a signal from the sub-pixel SP, convert the sampling result through an analog-to-digital converter (ADC) and output the converted signal.

The timing controller 11 controls general operations for driving the sensing mode according to a predetermined sensing process. The sensing mode may be driven according to user selection or can be performed according to a preset schedule. Data sensed as a result of the sensing mode operation is stored in the compensation memory 28 and is applied at the time of compensating for the data signal DATA to be written in the sub-pixel SP.

The compensation memory 28 stores OLED deterioration sensing data, and the compensator 26 can correct the data signal DATA to be written in the sub-pixel SP based on the data stored in the compensation memory 28 and then output the same to the data driver 12. Electrical characteristic data stored in the compensation memory 28 can further include threshold voltage, mobility and the like of the driving TFT DT as well as OLED deterioration data.

The OLED deterioration data stored in the compensation memory 28 may include sensing data SD directly sensed from the sub-pixel SP through the sensing unit 24. In addition, the OLED deterioration data can include data input from the outside of the display device, data updated from the outside, or data calculated based on internal sensing data.

Figure 4:
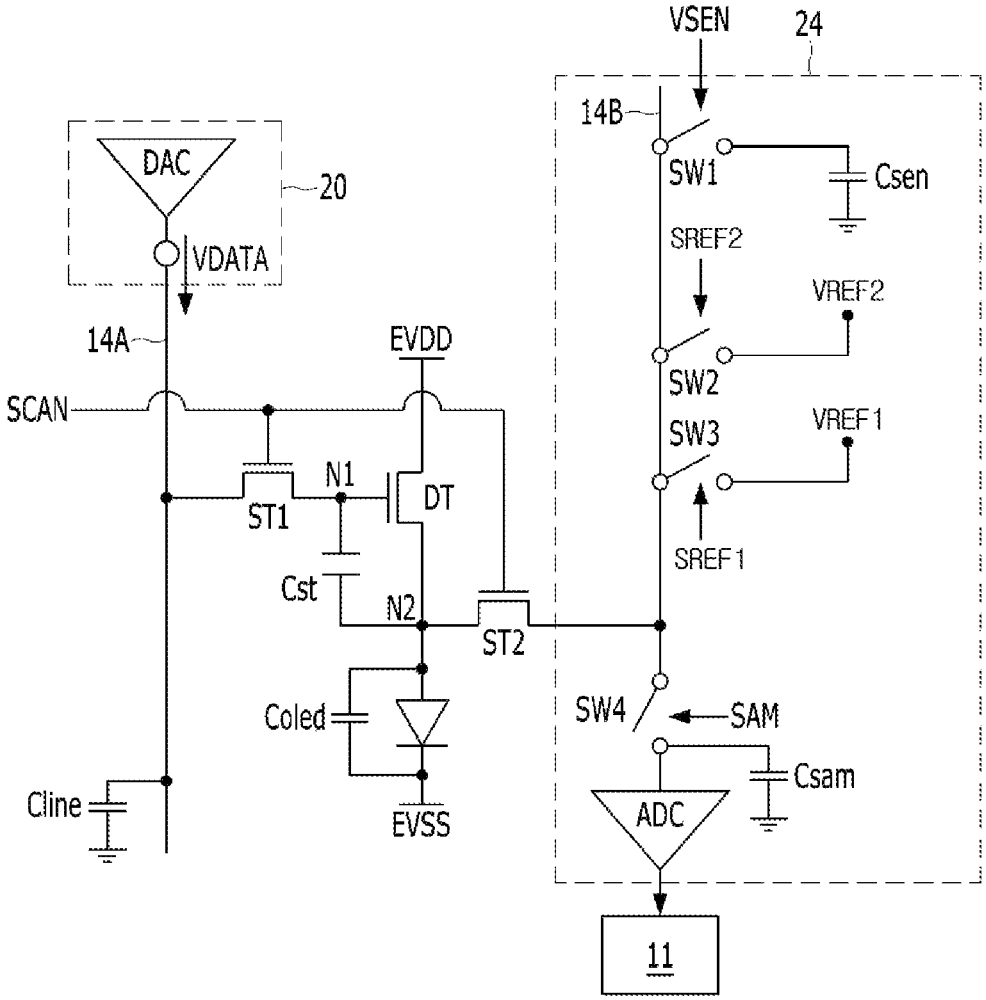
FIG. 4 is an exemplary diagram showing a sub-pixel circuit and a sensing structure of an organic light emitting display device (OLED) according to an aspect of the present disclosure.
Figure 5:
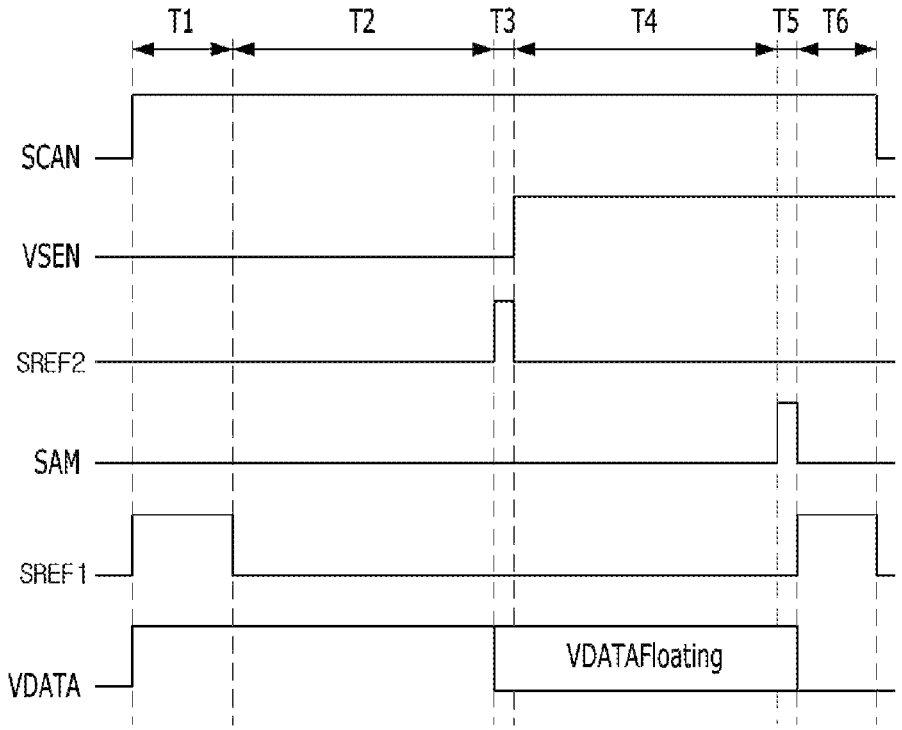
FIG. 5 is a driving timing diagram of a sensing operation of the organic light emitting display according to an aspect of the present disclosure.

FIG. 4 is an exemplary diagram of a sub-pixel circuit and a sensing structure of an organic light emitting display according to an aspect of the present disclosure and illustrates a sensing structure for sensing electrical characteristics of the sub-pixel SP in the 1-scan structure as shown in FIG. 2. FIG. 5 is a driving timing diagram during a sensing operation of the organic light emitting display of FIG. 4.

Referring to FIG. 4, the sub-pixel SP includes an OLED, a driving TFT DT, a storage capacitor Cst, and a first switch TFT ST1 and a second switch TFT ST2 that receive one scan signal SCAN.

The OLED includes an anode connected to a source node N2, a cathode connected to an input terminal of a low-potential driving voltage EVSS, and an organic compound layer positioned between the anode and the cathode. A parasitic capacitor Coled is generated in the OLED due to the anode, the cathode, and a plurality of insulating films present therebetween. The capacitance of such an OLED parasitic capacitor Coled is several pF, which is very small compared to several hundred to several thousand pF which is parasitic capacitance present in the sensing line 14B.

The driving TFT DT controls a driving current input to the OLED according to a gate-source voltage Vgs. The driving TFT DT includes a gate electrode connected to a gate node N1, a drain electrode connected to an input terminal of a high-potential driving voltage EVDD, and a source electrode connected to the source node N2. The storage capacitor Cst is connected between the gate node N1 and the source node N2.

The data line 14A connected to the first switch TFT ST1 of the sub-pixel is connected to the voltage supply unit 20 of the data driver 12 (shown in FIG. 3). The sensing line 14B connected to the second switch TFT ST2 is connected to the sensing unit 24 of the data driver 12 (shown in FIG. 3).

The data line 14A is connected to the digital-to-analog converter DAC of the voltage supply unit 20 to supply a display data voltage or a sensing data voltage. Parasitic capacitance of several hundred to several thousand pF can be generated in the data line 14A.

The voltage supply unit 20 generates a display data voltage in the display mode. In the display mode, the first switch TFT ST1 is turned on by a scan signal SCAN to apply the display data voltage supplied to the data line 14A to the gate node N1 of the driving TFT DT. In the sensing mode, the voltage supply unit 20 generates a preset sensing data voltage and supplies the same to the data line 14A. In the sensing mode, the sensing data voltage supplied to the data line 14A is applied to the gate node N1 of the driving TFT DT through the first switch TFT ST1. Accordingly, the gate-source voltage Vgs of the driving TFT DT of the sub-pixel SP is programmed by the sensing data voltage.

A sensing voltage sensed by the pixel is transmitted to the sensing unit 24 through the sensing line 14B. The sensing unit 24 can include an analog-to-digital converter ADC that senses the voltage of the sensing line 14B corresponding to the voltage of the source node N2 of the driving TFT DT and converts the sensed voltage into a digital sensing value, and first to fourth switches SW1, SW2, SW3, and SW4 for sensing operation.

The first to fourth switches SW1, SW2, SW3, and SW4 for sensing operation can control the voltage state of the sensing line 14B or control whether the sensing line 14B and the analog-to-digital converter (ADC) are connected and whether the sensing line 14B and a sensing capacitor Csen are connected.

The first switch SW1 operates according to a sensing signal VSEN to control whether the sensing line 14B is connected to the sensing capacitor Csen. The first switch SW1 can be turned on when the sensing signal VSEN is input, so that the sensing line 14B is connected to the sensing capacitor Csen.

The second switch SW2 operates according to a second reference voltage signal SREF2 to control whether the sensing line 14B is connected to a second reference voltage VREF2. The second reference voltage VREF2 can be supplied to the sensing line 14B during driving for sensing OLED deterioration (vsJB Fmode). The second switch SW2 can be turned on when the second reference voltage signal SREF2 is input, so that the sensing line 14B is connected to the second reference voltage VREF2.

The third switch SW3 operates according to a first reference voltage signal SREF1 to control whether the sensing line 14B is connected to a first reference voltage VREF1. The first reference voltage VREF1 can be supplied to the sensing line 14B during driving for OLED threshold voltage tracking. The third switch SW3 can be turned on when the first reference voltage signal SREF1 is input, so that the sensing line 14B is connected to the first reference voltage VREF1.

The fourth switch SW4 operates according to a sampling signal SAM to control whether the sensing line 14B, the ADC, and a sampling capacitor Csam are connected. The fourth switch SW4 can be turned on when the sampling signal SAM is input, so that the sensing line 14B, the ADC, and the sampling capacitor Csam are connected.

The sensing capacitor Csen is connected to or disconnected from the sensing line 14B according to the operation of the first switch SW1. The sensing capacitor Csen can be disconnected from the sensing line 14B during driving for OLED threshold voltage tracking (OLED Vth Tracking) and can be connected to the sensing line 14B during driving for OLED deterioration sensing (vsJB Fmode). The sensing capacitor Csen can be disconnected such that the sensing capacitor Csen is prevented from affecting the OLED threshold voltage. During driving for OLED deterioration sensing (vsJB Fmode), the sensing capacitor Csen can be connected to the sensing line 14B to sense voltage change for OLED Vth calculation.

FIG. 5 is a driving timing diagram during a sensing operation of the organic light emitting display device of FIG. 4.

Referring to FIG. 5, the sensing operation of the organic light emitting display device 100 according to an aspect of the present disclosure can be performed over first to sixth periods T1 to T6.

The scan signal SCAN is applied at an on level during the first to sixth periods T1 to T6. The scan signal SCAN is input to the first and second switches ST1 and ST2. Accordingly, the first and second switches ST1 and ST2 are turned on during the first to sixth periods T1 to T6.

The sensing signal VSEN is applied at an off level in the first to third periods T1 to T3 and is applied at an on level in the fourth to sixth periods T4 to T6. The sensing signal VSEN is input to the first switch SW1 to control connection of the sensing capacitor Csen.

The second reference voltage signal SREF2 is applied at an on level only in the third period T3 and is maintained at an off level during the remaining period. The second reference voltage signal SREF2 is input to the second switch SW2, so that the sensing line 14B is connected to the second reference voltage VREF2.

The sampling signal SAM is applied at an on level only in the fifth period T5, and is maintained at an off level during the remaining period. The sampling signal SAM is input to the fourth switch SW4 to control connection between the ADC and the sampling capacitor Csam.

The first reference voltage signal SREF1 is applied as an on level only in the first period T1 and the sixth period T6 and is maintained at an off level during the remaining period. The first reference voltage signal SREF1 is input to the third switch SW3, so that the sensing line 14B is connected to the first reference voltage VREF1.

The operation in each period will be described when the aforementioned driving signals are applied to the sub-pixel circuit and the sensing circuit of FIG. 4.

Figure 6:
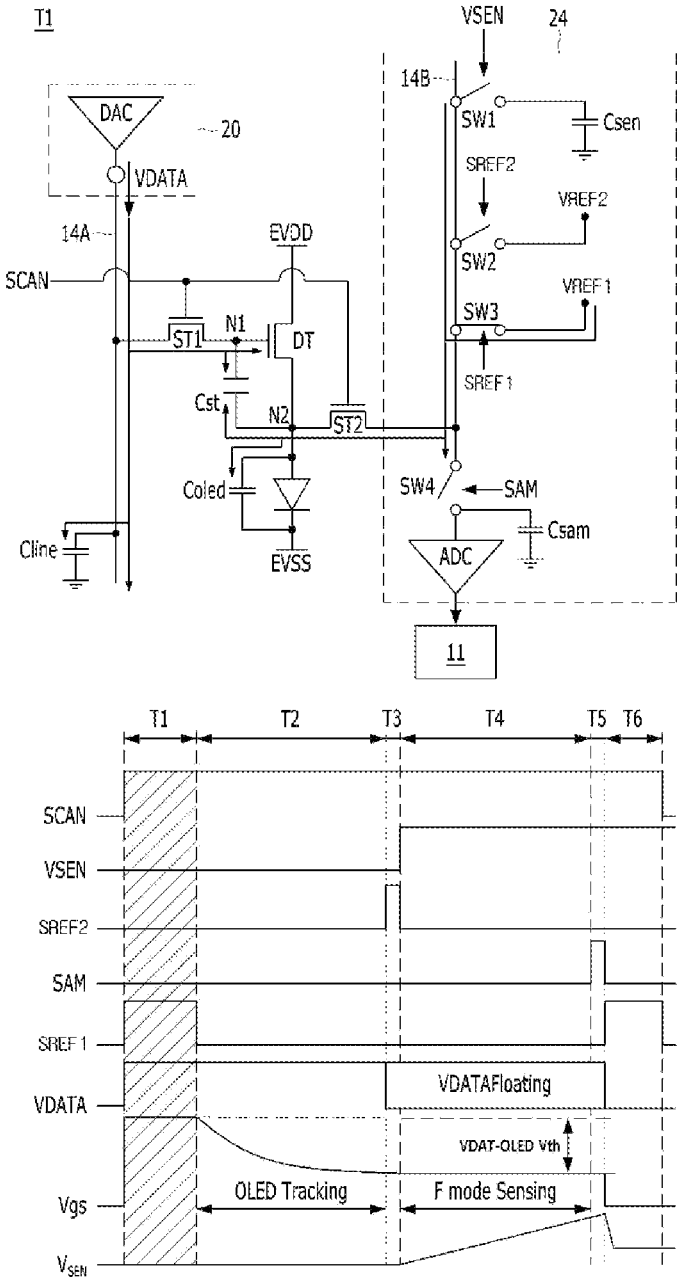
FIGS. 6 to 11 are diagrams illustrating a sensing mode operation of the organic light emitting display device according to an aspect of the present disclosure.
Figure 7:
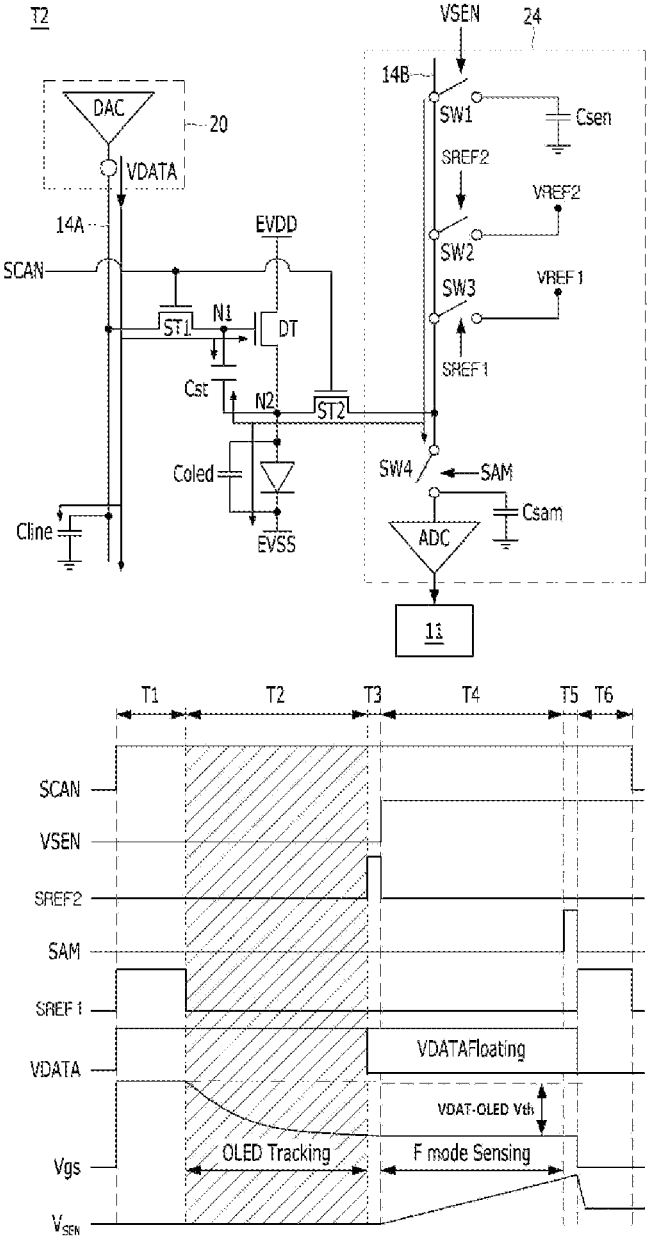
Figure 8:
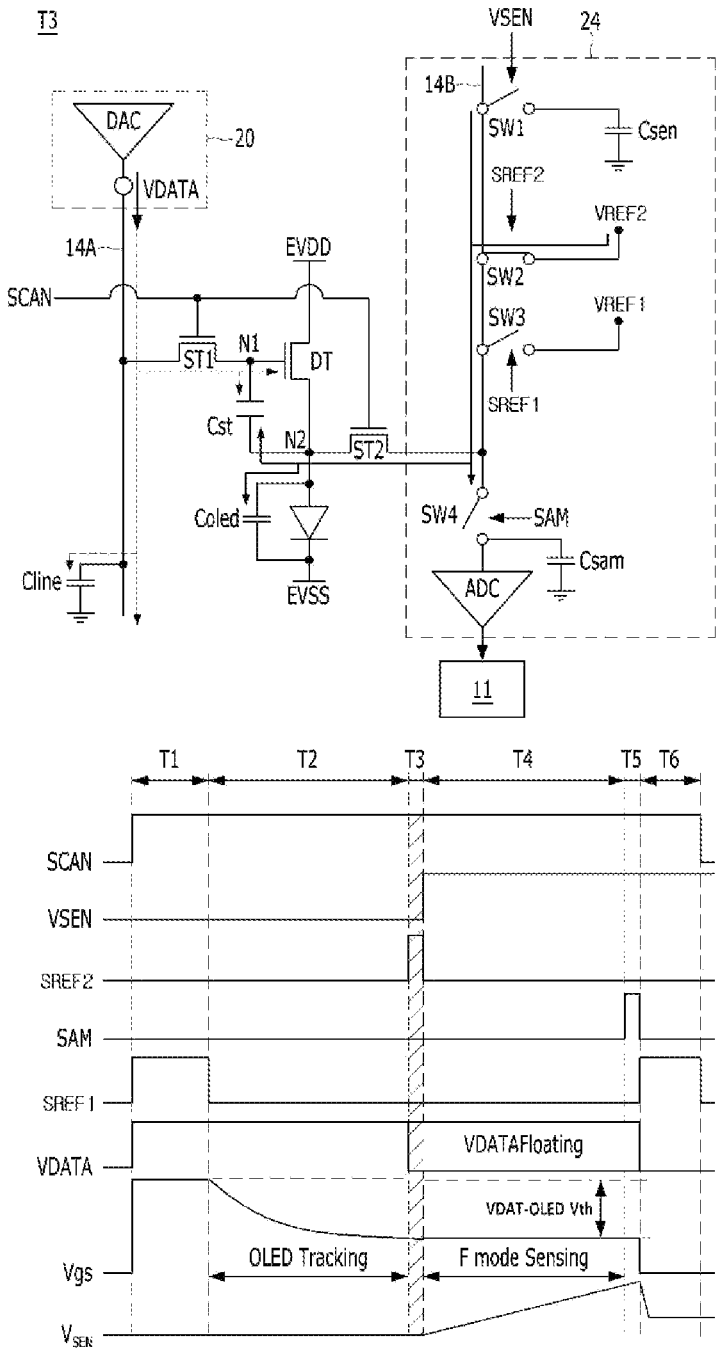

FIGS. 6 to 8 are diagrams for describing a sensing mode operation of the organic light emitting display device according to an aspect of the present disclosure and illustrate circuit operations and driving signals in the first to sixth periods T1 to T6, and change in the gate-source voltage Vgs of the driving TFT DT and change in the sensing voltage Vsen of the sensing capacitor Csen according thereto.

The scan signal SCAN is input at an on level to the first and second switches ST1 and ST2 over the first to sixth periods T1 to T6. Accordingly, the first and second switches ST1 and ST2 are maintained in a turned-on state during the first to sixth periods T1 to T6.

FIG. 6 is a diagram illustrating a circuit operation and driving signals in the first period T1, and change in the gate-source voltage Vgs of the driving TFT DT and change in the sensing voltage Vsen of the sensing capacitor Csen according thereto.

In the first period T1, the scan signal SCAN is applied at an on level. The sensing signal VSEN, the second reference voltage signal SREF2, and the sampling signal SAM are applied at an off level. The first reference voltage signal SREF1 is applied at an on level. A data voltage VDATA is applied to the data line 14A.

Since the sensing signal VSEN input to the first switch SW1, the second reference voltage signal SREF2 input to the second switch SW2, and the sampling signal SAM input to the fourth switch SW4 are at an off level, the first, second, and fourth switches SW1, SW2, and SW4 are turned off.

The data voltage VDATA is applied to the data line 14A, and thus the data voltage VDATA is applied to the gate node N1 through the first switch ST1.

The first reference voltage signal SREF1 is applied at an on level to turn on the third switch SW3, and thus the first reference voltage VREF1 is applied to the sensing line 14B. Accordingly, the first reference voltage VREF1 is applied to the source node N2 through the second switch ST2.

Therefore, the gate-source voltage Vgs of the driving TFT DT is set to "VDATA−VREF1".

FIG. 7 is a diagram illustrating a circuit operation and driving signals in the second period T2, and change in the gate-source voltage Vgs of the driving TFT DT and change in the sensing voltage Vsen of the sensing capacitor Csen according thereto. The voltage of the source node N2 of the driving TFT DT rises to the threshold voltage at which the OLED is turned on in the second period T2, and this second period T2 is referred to as an "OLED threshold voltage tracking period".

In the second period T2, the first reference voltage signal SREF1 switches to the off level and the remaining signals maintain the same state as in the first period T1. For example, the scan signal SCAN is maintained at an on level, and the sensing signal VSEN, the second reference voltage signal SREF2, the sampling signal SAM, and the first reference voltage signal SREF1 are applied at an off level. The data voltage VDATA is applied to the data line 14A.

As the first reference voltage signal SREF1 switches to the off level, the third switch SW3 is turned off and thus connection of the first reference voltage VREF1 is released. Accordingly, the source node N2 of the driving TFT DT floats and the voltage thereof rises to the threshold voltage at which the OLED is turned on, and thus the gate-source voltage Vgs of the driving TFT DT gradually decreases. When the voltage of the source node N2 of the driving TFT DT rises above the threshold voltage of the OLED, the OLED is turned on.

FIG. 8 is a diagram illustrating a circuit operation and driving signals in the third period T3, and change in the gate-source voltage Vgs of the driving TFT DT and change in the sensing voltage Vsen of the sensing capacitor Csen according thereto.

In the third period T3, the scan signal SCAN is applied at an on level and the sensing signal VSEN is applied at an off level. The second reference voltage signal SREF2 is applied at an on level. The sampling signal SAM is applied at an off level. The first reference voltage signal SREF1 is applied at an off level. The data voltage VDATA floats on the data line 14A.

In the third period T3, only the second reference voltage signal SREF2 switches to the on level and the remaining signals maintain the same state as in the second period T2.

Since the second reference voltage signal SREF2 is applied at an on level and the second switch SW2 is turned on, the second reference voltage VREF2 is applied to the sensing line 14B. The second reference voltage VREF2 can be set to the ground GND. The second reference voltage signal SREF2 is applied at an on level only during the third period T3, and thus the second reference voltage VREF2, For example, the ground GND is connected only during the third period T3. As the ground GND is connected to the sensing line 14B, the potential of the source node N2 is lowered to "OLED Vth−OLED Vth=0 V".

The data voltage VDATA of the data line 14A is switched to a floating state. When the line capacitor Vdata Line Cap of the data line 14A is sufficiently small, the voltage of the gate node N1 is also dropped by that of the source node N1. For example, the potential of the gate node N1 is lowered by reduction in the potential of the source node N2 from the potential of Vdata previously input and thus has a potential of "Vdata−OLED Vth".

When the line capacitor Vdata Line Cap of the data line 14A is sufficiently small, the gate-source voltage Vgs can be maintained by the capacitance of the driving TFT DT. Accordingly, the voltage of the gate node N1 also decreases by reduction in the voltage of the source node N2 due to the ground GND being connected, and thus the gate-source voltage Vgs is maintained without being changed. Accordingly, the source node N2 has a potential of "OLED Vth−OLED Vth=0 V" and the gate node N1 has a potential of "Vdata−OLED Vth".

Figure 9:
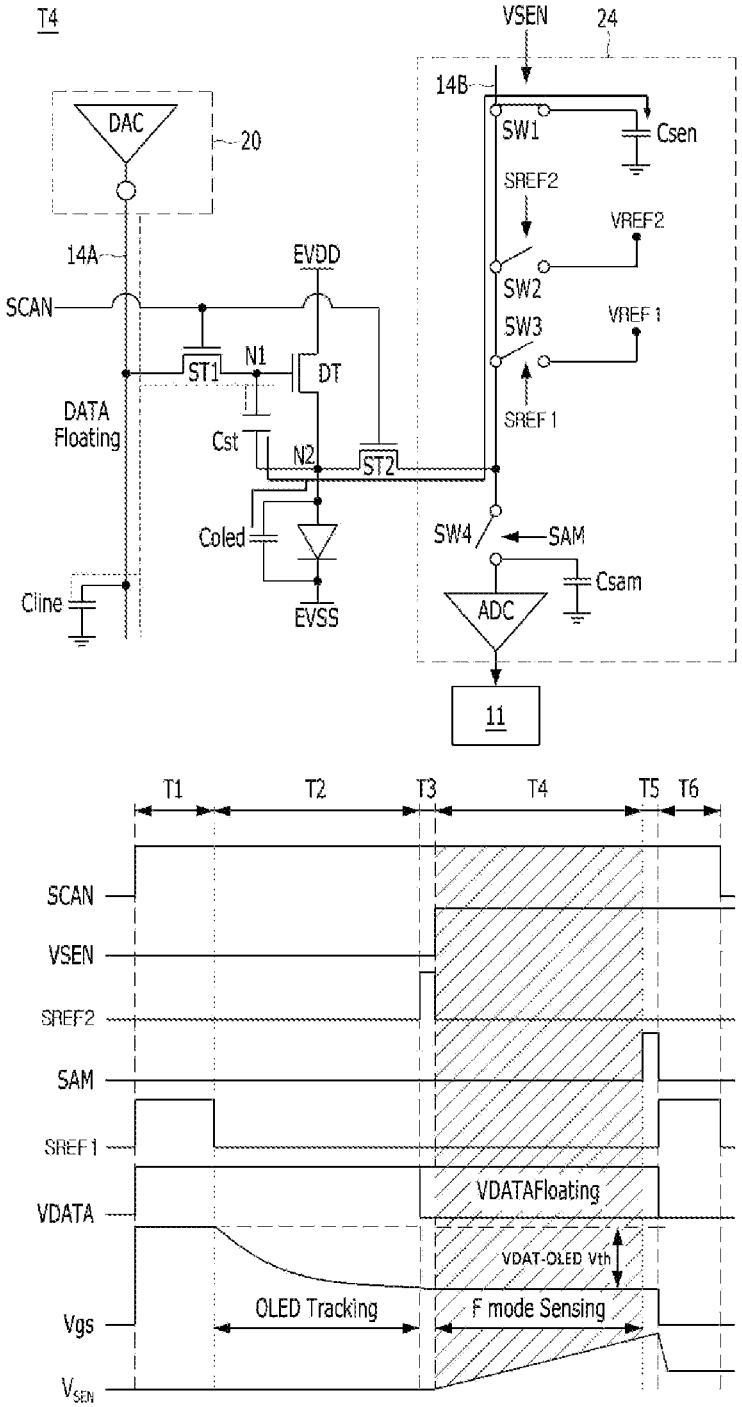

FIG. 9 is a diagram illustrating a circuit operation and driving signals in the fourth period T4, and change in the gate-source voltage (Vgs) of the driving TFT (DT) and change in the sensing voltage (Vsen) of the sensing capacitor (Csen) according thereto. In the fourth period T4, driving for sensing OLED deterioration (vsJB Fmode) is performed.

In the fourth period T4, the sensing signal VSEN switches to an on level and thus the first switch SW1 is turned on. Accordingly, the sensing capacitor Csen is connected to the sensing line 14B and driving for sensing OLED deterioration (vsJB Fmode) is performed. In the fourth period T4, the potential of the gate node N1 is "Vdata−OLED Vth" and the potential of the source node N2 is maintained in a state of "OLED Vth−OLED Vth=0". As a result, the gate-source voltage Vgs has a value of Vg(Vdata−OLED Vth)−Vs (OLED Vth−OLED Vth=0) which becomes "Vdata+OLED Vth".

The gate-source voltage Vgs maintained by the capacitance of the driving TFT DT is reflected in the sensing capacitor Csen connected to the sensing line 14B to which the source node N2 is connected and thus the sensing voltage Vsen is charged in the sensing capacitor Csen. Accordingly, the sensing capacitor Csen can be charged with the gate-source voltage Vgs. For example, the voltage of "Vdata+OLED Vth(Vg(Vdata−OLED Vth)−Vs(OLED Vth−OLED Vth=0))".

Figure 10:
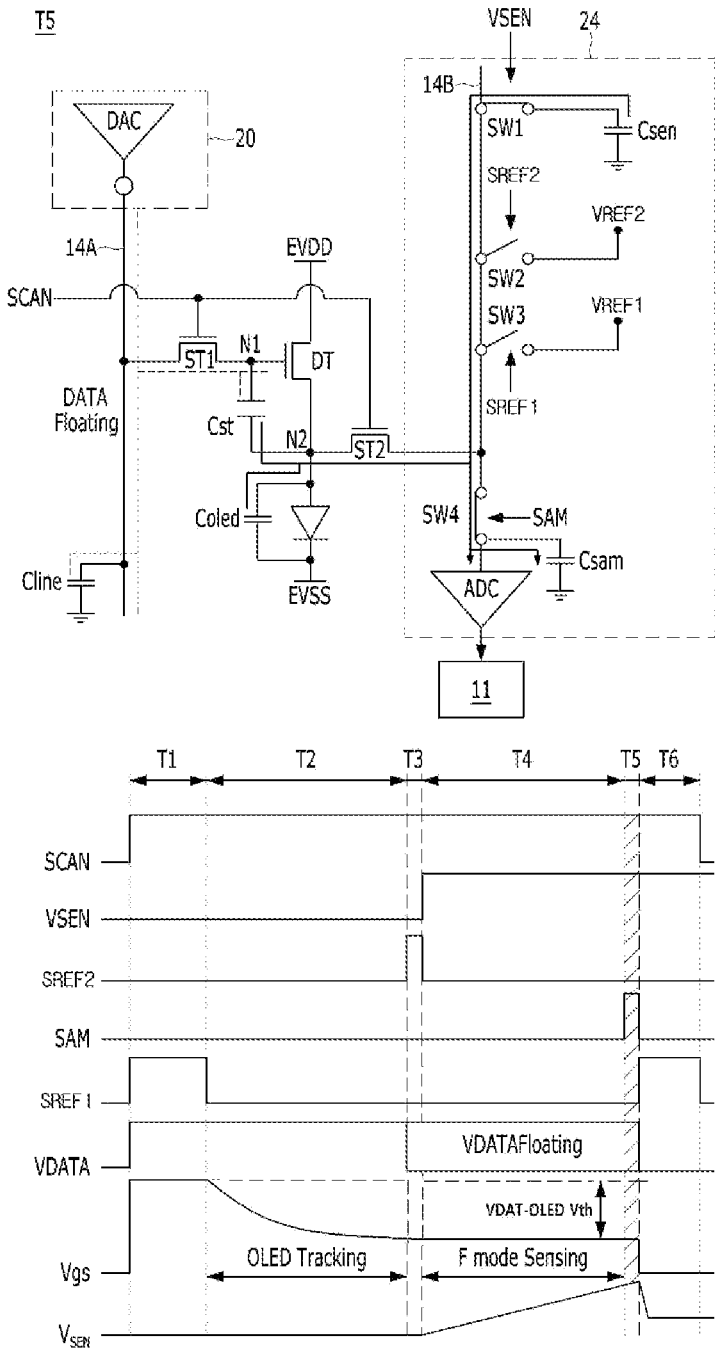

FIG. 10 is a diagram illustrating a circuit operation and driving signals in the fifth period T5, and change in the gate-source voltage Vgs of the driving TFT DT and change in the sensing voltage Vsen of the sensing capacitor Csen according thereto. In the fifth period T5, the threshold voltage of the OLED is sampled and output as sensing data through the analog-to-digital converter ADC.

In the fifth period T5, the sampling signal SAM is input at an on level while the sensing signal VSEN is maintained at an on level. The second reference voltage signal SREF2 and the first reference voltage signal SREF1 are maintained at an off level. The data voltage VDATA is maintained in a floating state on the data line 14A.

As the sensing signal VSEN is maintained at the on level, the first switch SW1 is turned on and thus the sensing capacitor Csen is connected to the sensing line 14B, and the fourth switch SW4 connects the ADC and the sampling capacitor Csam to the sensing line 14B according to the sampling signal SAM. Accordingly, charge stored in the sensing capacitor Csen connected to the sensing line 14B is sampled by the sampling capacitor Csam and output as sensing data through the ADC. Accordingly, the timing controller 11 can calculate the threshold voltage of the OLED based on the sensing data output through the ADC.

Figure 11:
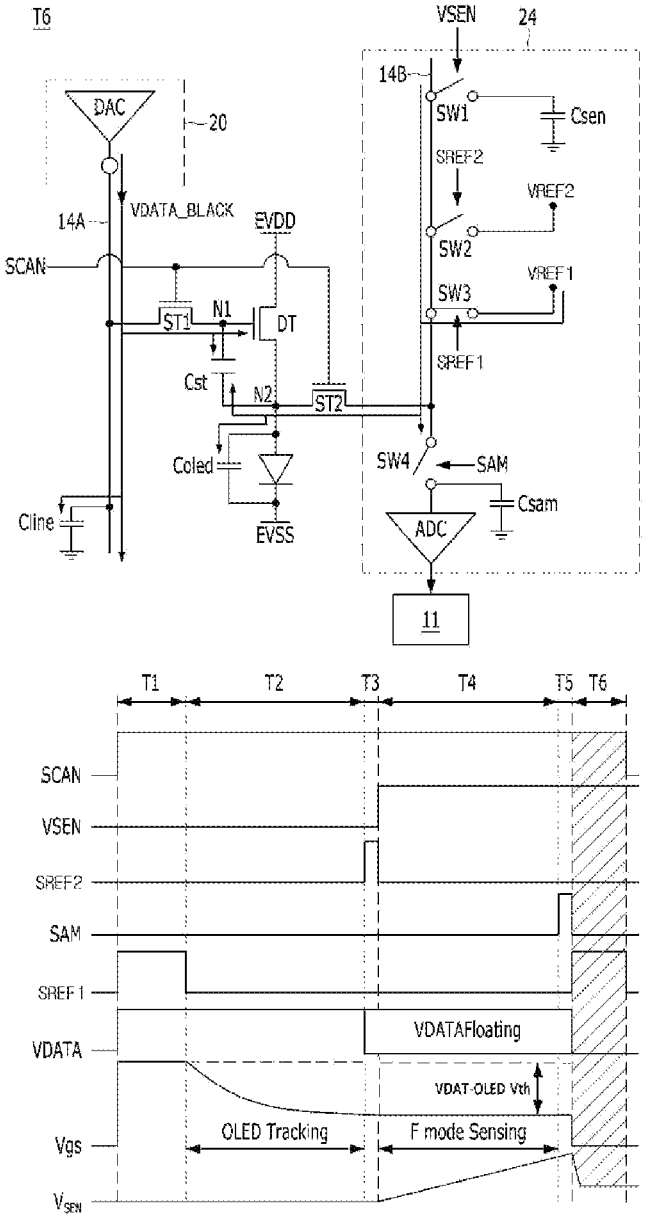

FIG. 11 is a diagram illustrating a circuit operation and driving signals in the sixth period T6, and change in the gate-source voltage Vgs of the driving TFT DT and change in the sensing voltage Vsen of the sensing capacitor Csen according thereto. After driving for sensing OLED deterioration (vsJB Fmode) is completed in the sixth period T6, initialization of the sensing line 14B is performed.

In the sixth period T6, the scan signal SCAN is applied at an on level. The sensing signal VSEN, the second reference voltage signal SREF2, and the sampling signal SAM are applied at an off level. The first reference voltage signal SREF1 is applied at an on level.

The sensing signal VSEN input to the first switch SW1, the second reference voltage signal SREF2 input to the second switch SW2, and the sampling signal SAM input to the fourth switch SW4 are at an off level, and thus the first, second, and fourth switches SW1, SW2, and SW4 are turned off.

A black data voltage VDATA_Black is applied to the data line 14A, so that a sensed line does not emit light.

By performing the above-described process, the timing controller 11 may receive sensing data from the sensing unit 24 and calculate the threshold voltage of the OLED based on the received sensing data.

The sensing data input to the timing controller 11 is a voltage charged in the sensing capacitor Csen in the fifth period T5. Charge reflecting the gate-source voltage Vgs in the fourth period T4 is charged in the sensing capacitor Csen. The gate-source voltage Vgs in the fourth period T4 has a value of Vg(Vdata−OLED Vth)−Vs(OLED Vth−OLED Vth=0), which corresponds to a voltage value of "Vdata+OLED Vth". The timing controller 11 can calculate the threshold voltage of the OLED (OLED Vth) based on the gradient of the sensing voltage Vsen charged in the sensing capacitor Csen.

Hereinafter, a method of calculating OLED Vth according to the present disclosure will be described with reference to FIGS. 12 and 13.

The timing controller 11 can calculate the OLED Vth by calculating the sensing voltage Vsen received through the sensing operation in the first to sixth periods T1 to T6 using the threshold voltage Vth and mobility of the driving TFT DT stored in the compensation memory 28 in advance.

The compensation memory 28 of the timing controller 11 stores the threshold voltage Vth of the driving TFT DT, the mobility of the driving TFT DT, and the like. The threshold voltage Vth of the driving TFT DT and the mobility of the driving TFT DT can be sensed in real time, stored in advance, or calculated based on a sensed value.

Figure 12:
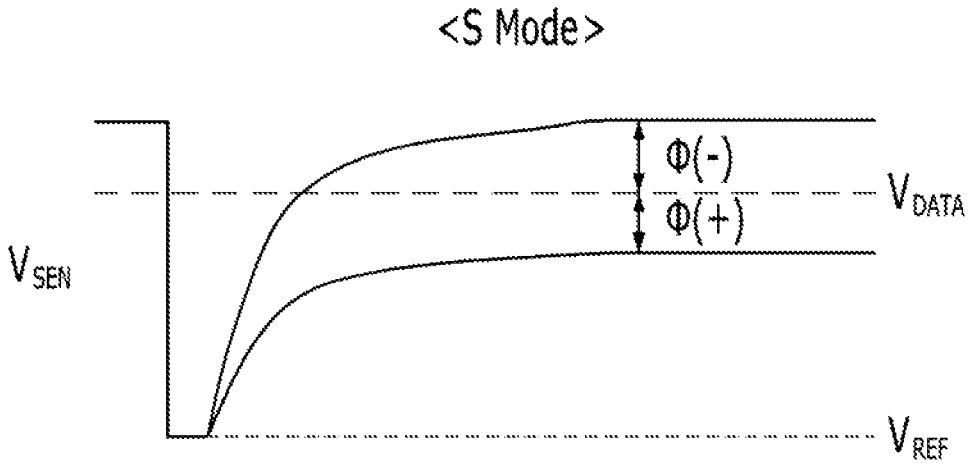
FIGS. 12 and 13 are graphs for describing an OLED Vth calculation method according to an aspect of the present disclosure.
Figure 13:
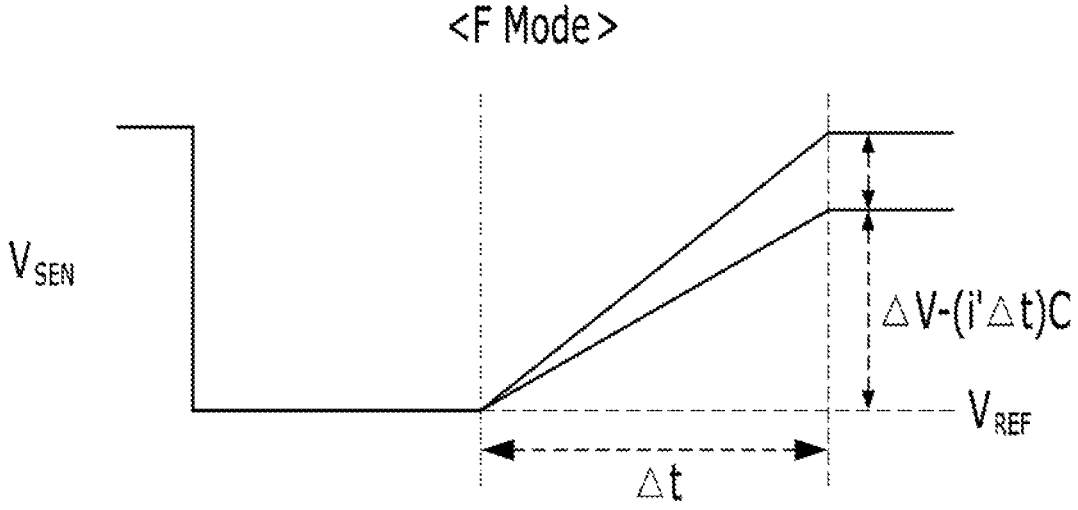

FIG. 12 is a graph for describing the threshold voltage Vth of the driving TFT DT, and FIG. 13 is a graph for describing the mobility of the driving TFT DT.

Referring to FIG. 12, <S Mode> is a graph showing a relationship between a voltage $V_{SEN}$ sensed as a result of execution of the sensing mode for sensing Vth of the driving TFT DT and a data voltage $V_{DATA}$ input for sensing. As shown in the graph of FIG. 12, a positive (+) or negative (−) shift value of the threshold voltage Vth of the driving TFT DT can be calculated through the difference between the sensed voltage $V_{SEN}$ and the data voltage $V_{DATA}$ input for sensing.

Referring to FIG. 13, <F Mode> is a graph showing sensing results of the voltage $V_{SEN}$ sensed as a result of execution of the sensing mode for sensing the mobility of the driving TFT DT. As shown in the graph of FIG. 13, the mobility of the driving TFT DT can be calculated according to variation ΔV of the sensed voltage $V_{SEN}$ for a predetermined time Δt.

As described above, the threshold voltage Vth of the driving TFT DT and the mobility of the driving TFT DT can be sensed by various methods such as real-time sensing and stored in the compensation memory 28, and the timing controller 11 can compensate for data by putting current flowing in a saturation region of the driving TFT DT into a current calculation formula according to the stored threshold voltage Vth of the driving TFT DT and the mobility of the driving TFT DT.

$$Id = \frac{1}{2} unCox(Vgs - Vth)^2 \quad \text{(Equation 1)}$$

In Equation 1, the coefficient "½unCox" related to the mobility of the driving TFT DT and the threshold voltage Vth of the driving TFT DT are stored in advance in the compensation memory 28 as described above, and thus the current expression excluding the relevant coefficient is as follows.

$$I=(Vgs)^2 \quad \text{<Equation 2>}$$

In Equation 2, the current I can be calculated by checking the voltage charged in the sensing capacitor Csen.

$$I = (Vgs)^2 = C\frac{dv}{dt} \quad \text{(Equation 3)}$$

In Equation 3, dt represents a predetermined time, For example, a time taken for F mode sensing, and dv can be confirmed through sensing data input to the ADC after sampling. For example, by substituting the known constants C, dv, and dt in Equation 3, the current value I can be calculated.

When the current value I is calculated, it is possible to calculate the potential of the gate node N1 by substituting the current value into Equation 4 as follows.

$$I=(Vgs)^2=(Vgate-Vsource)^2=(Vg)^2 \quad \text{<Equation 4>}$$

In Equation 4, when the second reference voltage VREF2, i.e., the ground voltage, is applied to the sensing node 14B, the voltage of the source node N2 becomes 0 V, and thus the current expression can be simplified to. $(Vgate-Vsource)^2=(Vg)^2$. Therefore, the value Vg can be obtained by calculating the square root $\sqrt{I}$ of the current value.

As described above, the current value I can be calculated using the previously stored threshold voltage Vth and mobility of the driving TFT DT, and the square root of the calculated current value can be calculated to obtain the potential of Vg. Accordingly, OLED Vth at the point in time when the current flows through the OLED can be calculated by subtracting the potential of the data input for performing the sensing mode of the present disclosure from the calculated potential of Vg.

As described above, according to the organic light emitting display device and the driving method thereof of the present disclosure, it is possible to add the sensing capacitor Csen applicable for sensing to a sensing line to prevent the sensing capacitor Csen from affecting the threshold voltage of the OLED by disconnecting the sensing capacitor Csen at the time of driving for OLED threshold voltage tracking and to detect voltage change by connecting the sensing capacitor Csen to the sensing line 14B at the time of driving for OLED deterioration sensing (vsJB Fmode).

Therefore, 100 ms or longer per line is required to directly sense the threshold voltage Vth of the OLED in conventional technology because, after input of an initialization voltage Vini to drive the OLED, it is necessary to wait until the input voltage is discharged to the threshold voltage of the OLED in a state in which the scan TFT is turned off, whereas the present disclosure disconnects the sensing capacitor Csen at the time of driving for OLED threshold voltage tracking to prevent the sensing capacitor Csen from affecting the threshold voltage of the OLED and connects the sensing capacitor Csen to the sensing line 14B at the time of driving for OLED deterioration sensing (vsJB Fmode) to detect voltage change, and thus can sense the threshold voltage Vth of the OLED within about 1.6 ms, which is significantly reduced as compared to the conventional technology.

Those skilled in the art from the above description will be able to see that various changes and modifications are possible without departing from the technical spirit of the present specification. Accordingly, the technical scope of the present specification should not be limited to the contents described in the detailed description of the specification, but should be defined by the claims.

What is claimed is:

1. An organic light emitting display device comprising:

an organic light emitting element emitting light;

a driving transistor configured to control a driving current supplied to the organic light emitting element;

a first switch transistor configured to transfer a voltage input through a data line to a first node of the driving transistor;

a second switch transistor simultaneously turned on/off with the first switch transistor and connecting a second node of the driving transistor and a sensing line; and a sensing unit connected to the sensing line to sample a voltage of the sensing capacitor and output a sensing result related to the threshold voltage of the organic light emitting element, wherein the sensing unit includes:

a sensing capacitor connected to the sensing line and storing a sensing voltage during a threshold voltage sensing period; and a first switch configured to disconnect the sensing capacitor from the sensing line during a period in which sensing data for sensing a threshold voltage of the organic light emitting element is input to the data line and to connect the sensing capacitor to the sensing line during the threshold voltage sensing period, a second switch configured to connect the sensing line and a first reference voltage for initializing the second node;

a third switch configured to connect the sensing line and a second reference voltage for grounding the second node; and a fourth switch configured to connect the sensing line and an analog-to-digital converter to sample the voltage of the sensing capacitor.

2. The organic light emitting display device of claim 1, wherein the period in which sensing data for sensing the threshold voltage of the organic light emitting element is performed during a sensing mode that includes first to sixth periods, and the first switch transistor and the second switch transistor are turned on during the first to sixth periods, a sensing data voltage for driving the sensing mode is input to the first node of the driving transistor through the data line, and the first reference voltage is input to the second node of the driving transistor through the sensing line during the first period, input of the first reference voltage is canceled and input of the sensing data voltage is maintained to increase a potential of the second node to a threshold voltage at which the organic light emitting element is turned on during the second period, the data voltage of the first node is maintained in a floating state, and the second reference voltage lower than the first reference voltage is input to the sensing line to adjust the potential of the second node increased to the threshold voltage to the second reference voltage during the third period, the sensing capacitor is connected to the sensing line to sense a voltage difference between the second node adjusted to the second reference voltage and the first node in which voltage adjustment of the second node has been reflected using the sensing capacitor during the fourth period, and the voltage sensed by the sensing capacitor is sampled during the fifth period.

3. The organic light emitting display device of claim 2, wherein, after the fifth period, a black data voltage is input to the first node of the driving transistor through the data line and the first reference voltage is input to the second node of the driving transistor through the sensing line in the sixth period.

4. The organic light emitting display device of claim 1, further comprising a capacitor electrically connected between the first node and the second node.

5. The organic light emitting display device of claim 1, wherein the first switch transistor and the second switch transistor maintain a turned-on state during the period in which the sensing data is input and the threshold voltage sensing period.

6. The organic light emitting display device of claim 1, further comprising a timing controller configured to receive a sensing result from the sensing unit and to calculate the threshold voltage of the organic light emitting element by calculating a voltage change rate per unit time in the sensing capacitor according to the sensing result.

7. A method of driving an organic light emitting display device in which a plurality of data lines and a plurality of sensing lines are disposed, and a plurality of sub-pixels each having an organic light emitting element and a driving transistor are arranged, the method comprising:

a first period in which a sensing data voltage for driving a sensing mode is input to a first node of the driving transistor through a corresponding data line, and a first reference voltage is input to a second node of the driving transistor through a corresponding sensing line at the time of driving the sensing mode for sensing a threshold voltage of the organic light emitting element;

a second period in which input of the first reference voltage to the second node is canceled and input of the sensing data voltage is maintained to increase a potential of the second node to a threshold voltage at which the organic light emitting element is turned on;

a third period in which the data voltage of the first node is maintained in a floating state, and a second reference voltage lower than the first reference voltage is applied to the sensing line to adjust the potential of the second node increased to the threshold voltage to the second reference;

a fourth period in which a sensing capacitor is connected to the sensing line to sense a voltage difference between the second node adjusted to the second reference voltage and the first node in which voltage adjustment of the second node has been reflected using the sensing capacitor; and a fifth period in which the voltage sensed by the sensing capacitor is sampled.

8. The method of claim 7, wherein the organic light emitting display device further includes a sensing unit configured to sample a voltage input through the sensing line and output a sensing voltage related to the threshold voltage of the organic light emitting element.

9. The method of claim 8, wherein the sensing unit includes:

a first switch configured to connect the sensing line and the sensing capacitor;

a second switch configured to connect the sensing line and a first reference voltage for initializing the second node;

a third switch configured to connect the sensing line and a second reference voltage for grounding the second node; and a fourth switch configured to connect the sensing line and an analog-to-digital converter to sample the voltage of the sensing capacitor.

10. The method of claim 7, wherein, after the fifth period, a black data voltage is input to the first node of the driving transistor through the data line and the first reference voltage is input to the second node of the driving transistor through the sensing line in the sixth period.

11. The method of claim 7, further comprising calculating a voltage change rate per unit time in the sensing capacitor based on the voltage sensed by the sensing capacitor and calculating the threshold voltage of the organic light emitting element according to the voltage change rate to compensate for an image data voltage input to the organic light emitting element.

12. The method of claim 7, wherein each sub-pixel includes:

a first transistor electrically connected to the first node of the driving transistor and a corresponding data line among the plurality of data lines;

a second transistor electrically connected to the second node of the driving transistor and a corresponding sensing line among the plurality of sensing lines according to the same scan signal input through the same scan line as that for the first transistor; and a capacitor electrically connected between the first node and the second node of the driving transistor.

* * * * *